US008626047B2

(12) United States Patent
Nakamura

(10) Patent No.: US 8,626,047 B2
(45) Date of Patent: Jan. 7, 2014

(54) FIXING DEVICE FOR FIXING DEVELOPER TO RECORDING MATERIAL AND IMAGE FORMING APPARATUS EQUIPPED WITH THE SAME

(75) Inventor: Hirokazu Nakamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 212 days.

(21) Appl. No.: 13/238,676

(22) Filed: Sep. 21, 2011

(65) Prior Publication Data

US 2012/0093549 A1 Apr. 19, 2012

(30) Foreign Application Priority Data

Oct. 14, 2010 (JP) ..... 2010-231515

(51) Int. Cl.
*G03G 15/20* (2006.01)

(52) U.S. Cl.
USPC ..... 399/329

(58) Field of Classification Search
USPC ..... 399/329, 323
See application file for complete search history.

(56) References Cited

U.S. PATENT DOCUMENTS 7,546,078 B2 * 6/2009 Okuda et al. ..... 399/329
7,890,038 B2 * 2/2011 Chikugo et al. ..... 399/323

FOREIGN PATENT DOCUMENTS

JP 2005-227463 8/2005
JP 2006-284874 10/2006
JP 2010-204222 9/2010

* cited by examiner

*Primary Examiner* — Quana M Grainger
(74) *Attorney, Agent, or Firm* — Renner, Otto, Boisselle & Sklar, LLP

(57) ABSTRACT

A fixing device includes: a fixing belt in an endless form; a fixing roller; a separating roller for separating, from the fixing belt, a paper sheet onto which a developer is fixed and fused; a heating roller for heating the fixing belt; a pressurizing roller for forming a fixing nip portion between the fixing belt and the pressurizing roller; a first lever to which the fixing roller and the separating roller are fixed, the first lever pivoting around a first supporting point used as the center point; a second lever to which the fixing roller and the heating roller are fixed, the second lever pivoting around a second supporting point used as the center point; a first spring for biasing the first lever; and a second spring for biasing the second lever.

6 Claims, 5 Drawing Sheets

FIXING DEVICE FOR FIXING DEVELOPER TO RECORDING MATERIAL AND IMAGE FORMING APPARATUS EQUIPPED WITH THE SAME

CROSS REFERENCE

This Nonprovisional application claims priority under 35 U.S.C. §119(a) on Patent Application No. 2010-231515 filed in Japan on Oct. 14, 2010, the entire contents of which are hereby incorporated by reference.

BACKGROUND OF THE INVENTION

The present invention relates to a fixing device for fixing a developer to a recording material and also relates to an image forming apparatus provided with such a fixing device.

An electrophotographic image forming apparatus includes a fixing device so as to fix and fuse a toner image transferred onto a sheet. In a conventional fixing device, a pressurizing roller is usually brought into pressure contact with a heating roller.

Recently, individual parts in image forming apparatuses have been improved to meet the needs of speeding up image formation (printing). A fixing device has been improved to increase a nip length of a fixing nip portion in order to provide an amount of heat necessary for a toner image to be fixed and fused onto a sheet conveyed at a high speed. For example, Japanese Patent Laid-Open Publication No. 2005-227463, as shown in FIG. 5, discloses a fixing device provided with: a heating roller 1001; a pressurizing roller 1002 that is pressed against the heating roller 1001; a belt stretching roller 1003 that is disposed on an upstream side in a paper conveying direction with respect to the pressurizing roller 1002 and is arranged on the pressurizing roller 1002 to be biased in the direction of an arrow G through a tension spring (not shown); a belt 1004 that is wrapped around the outer peripheries of the pressurizing roller 1002 and the belt stretch roller 1003 and moves while forming a fixing nip portion 1005 between the heating roller 1001 and the belt itself; and a preload spring (not shown) that biases the belt stretching roller 1003 in the direction of an arrow J and brings the belt stretch roller 1003 into contact with the heating roller 1001.

According to the fixing device described in Japanese Patent Laid-Open Publication No. 2005-227463, the belt 1004 is always stretched because the belt stretching roller 1003 is biased in the direction of the arrow G by the tension spring. For this reason, as the belt 1004 is extended in connection with a continuous use of the fixing device for a long period of time, the belt stretching roller 1003 moves to a position shown by a chain double-dashed line, and the nip length of the fixing nip portion 1005 changes (the nip length becomes longer in this case). As a result, a problem of exerting an adverse influence on toner fixation is caused.

In view of the above-stated problem, it is an object of the present invention to provide a fixing device capable of stably performing a fixing process without changing a nip length of a fixing nip portion and to provide an image forming apparatus including the fixing device.

SUMMARY OF THE INVENTION

A fixing device according to the present invention includes a fixing belt, a fixing roller, a separating roller, a heating roller, a pressurizing roller, a first lever, a second lever, a first biasing member, and a second biasing member.

The fixing belt is formed into an endless belt. The fixing roller suspends the fixing belt with the separating roller and the heating roller. The separating roller separates a recording material from the fixing belt. The pressurizing roller presses against the fixing roller and the separating roller through the fixing belt to form a fixing nip portion between the fixing belt and the roller itself. The heating roller includes a core metal portion and a heat source for heating the core metal portion, suspends the fixing belt by the core metal portion, and heats the fixing belt. The first lever, to which a rotating shaft of the fixing roller and a rotating shaft of the separating roller are fixed, pivots around the rotating shaft of the fixing roller by using the rotating shaft as a supporting point. The second lever, to which the rotating shaft of the fixing roller and a rotating shaft of the heating roller are fixed, pivots around the rotating shaft of the fixing roller by using the rotating shaft as a supporting point. The first biasing member biases the first lever and causes the separating roller to press against the pressurizing roller. The second biasing member biases the second lever and causes the fixing belt to stretch over the heating roller.

With this structure, the nip length of the fixing nip portion is always constant because the fixing roller and the separating roller that are in pressure contact with the pressurizing roller have respective rotating shafts that are fixed to the first lever. A developer can be thus stably fixed and fused on a recording material.

In addition, the fixing belt, by using the fixing roller as a supporting point, is stretched with a constant tension by the separating roller fixed to the first lever and the heating roller fixed to the second lever. Therefore, the fixing belt can be prevented from being deflected in the fixing nip portion. Even if the fixing belt bends or extends with time, an interaction between the first lever and the second lever can stretch the fixing belt with a constant tension.

Moreover, the heating roller includes no elastic layer, and the fixing belt is suspended by the core metal portion of the heating roller. For that reason, the heating roller has a small heat capacity and can heat the core metal portion and the fixing belt with a little energy and a short time. The adoption of a fixing belt having a small heat capacity and the rotation of the fixing belt at a high speed can also improve the heat transfer characteristics to the fixing nip portion. Thus, the fixing process can be performed in a short time after starting.

Furthermore, the distance from the heating roller to the fixing roller, that is, the distance to the fixing nip portion, is always constant because each of the rotating shafts of the fixing roller and the heating roller is fixed to the second lever. In the case where the fixing belt is moved (rotated) at a constant speed, the time until a portion of the fixing belt heated by the heating roller reaches the fixing nip portion becomes constant, so that the amount of heat given to a recording material in the fixing nip portion can be made constant. A developer can be thus stably fixed and fused on the recording material.

The fixing device of the above-stated invention includes a third lever and a third biasing member. The third lever, to which a rotating shaft of the pressurizing roller is fixed, pivots around a point that is separated, by a predetermined distance, from the pressurizing roller by using the point as a third supporting point. The third biasing member, in the third lever, is attached as opposed to the third supporting point with the pressurizing roller held therebetween, biases the third lever to cause the pressurizing roller to press against the fixing roller.

The structure enables the third biasing member to bias the third lever with a small power by the principle of the lever. In addition, the positional adjustment of the pressurizing roller with respect to other rollers is not required, and the pressurizing roller can be easily attached.

The fixing device of the above-stated invention includes a heat source provided in the pressurizing roller. Heating the fixing belt by the heat source of the pressurizing roller in an auxiliary manner can surely fix and fuse toner.

An image forming apparatus of the present invention includes the fixing device of the above-stated invention, and an image forming portion. The image forming portion transfers a developer to the recording material conveyed to the fixing device to thereby form an image.

This structure prevents faulty fixation from occurring and can form an image of good quality because the image that the image forming portion forms on the recording material is stably and surely fixed and fused by the fixing device.

The foregoing and other features and attendant advantages of the present invention will become more apparent from the reading of the following detailed description of the invention in conjunction with the accompanying drawings.

DETAILED DESCRIPTION OF THE INVENTION

Figure 1:
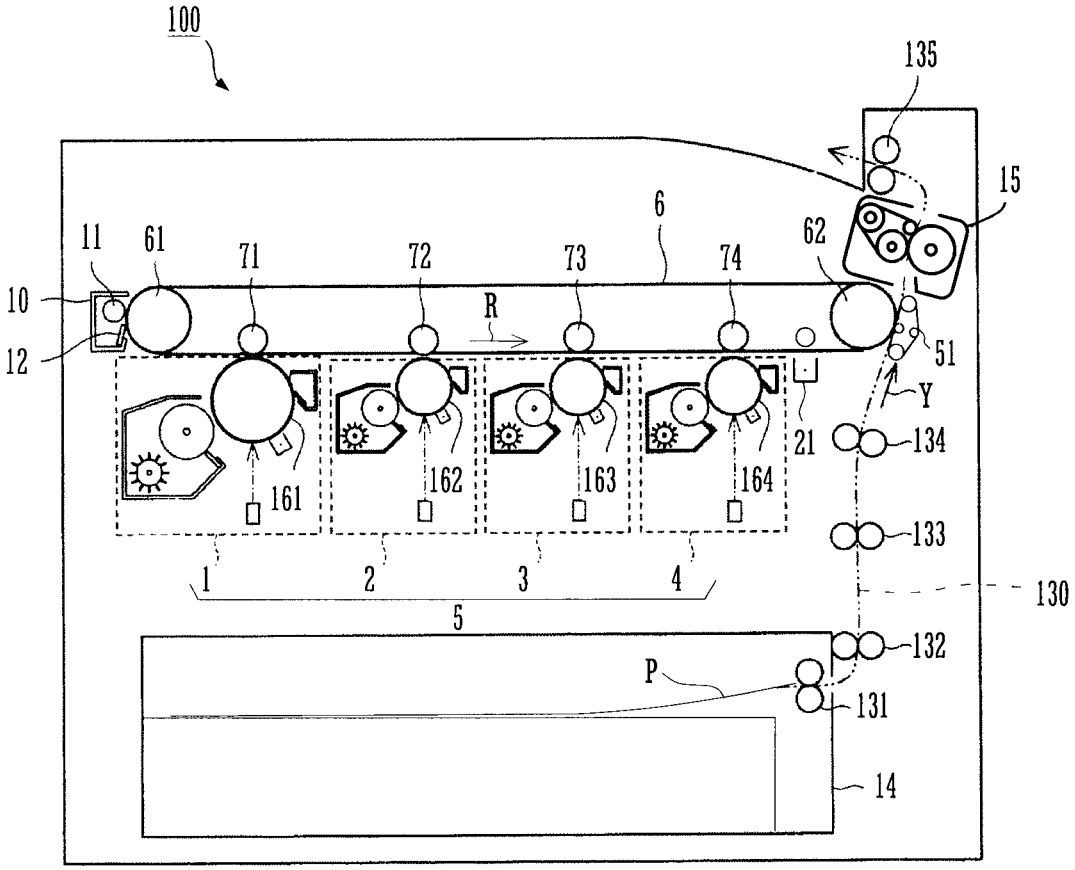
FIG. 1 shows a structure of an image forming apparatus according to an embodiment of the present invention.

As shown in FIG. 1, the image forming apparatus 100 is a tandem-type color image forming apparatus including a first image forming unit 1 for forming a yellow toner image, a second image forming unit 2 for forming a magenta toner image, a third image forming unit 3 for forming a cyan toner image, and a fourth image forming unit 4 for forming a black toner image. Hereinafter, the four image forming units that the image forming apparatus 100 includes are collectively referred to as an image forming unit group 5.

In FIG. 1, a primary transfer belt (an endless belt) 6 is disposed above the image formation unit group 5. The primary transfer belt 6 is passed over a support roller 61 and a primary transfer belt drive roller 62 to be stretched in a looped shape, and rotates in a direction indicated by an arrow R. The primary transfer belt 6 is made of resin such as polyimide or polyamide with an electrically conductive material having electronic conductivity being included therein and is formed in a shape of a thin film.

The image forming unit group 5 includes the first image forming unit 1, the second image forming unit 2, the third image forming unit 3, and the fourth image forming unit 4, which are disposed in this order along the primary transfer belt 6 in the direction of the arrow R.

On the inner peripheral side of the primary transfer belt 6 are disposed primary transfer rollers 71, 72, 73, 74 for respectively transferring, onto the primary transfer belt 6, the single color toner images that are respectively formed by the image forming unit group 5. The primary transfer rollers 71, 72, 73, 74 around which the primary transfer belt 6 is stretched, are respectively disposed, with the primary transfer belt 6 held therebetween, as opposed to photoreceptor drums 161, 162, 163, 164 installed in the image forming unit group 5. The single color toner images that are respectively formed by the image forming unit group 5 are sequentially transferred (primarily transferred) onto the primary transfer belt 6 in such a manner as to be overlapped to form one color toner image. The primary transfer belt 6, corresponding to an image bearing member, conveys the primarily transferred toner image to a secondary transfer position. Hereinafter, in the primary transfer belt 6, the support roller 61 side is referred to as the upstream side, and the primary transfer belt drive roller 62 side is referred to as the downstream side.

In the secondary transfer position as opposed to the primary transfer belt drive roller 62 with the primary transfer belt 6 held therebetween, a secondary transfer unit 51 is disposed. The color toner image that has been formed on the primary transfer belt 6 is transferred onto a paper sheet (a recording material) P by an electrostatic force in the secondary transfer position where the primary transfer belt drive roller 62 and the secondary transfer unit 51 are opposed to each other.

In a position opposed to the support roller 61 with the primary transfer belt 6 held therebetween, a primary transfer belt cleaning unit 10 for cleaning the surface of the primary transfer belt 6 is installed. The primary transfer belt cleaning unit 10 includes: a belt cleaning brush 11 that is disposed in contact with the primary transfer belt 6; and a belt cleaning blade 12, and removes toner and the like that remain on the primary transfer belt 6 without having been transferred onto the paper sheet P.

With reference to FIG. 1, a tray 14 for storing the paper sheet P therein is disposed in the lower part of the image formation unit group 5. The paper sheet P in the tray 14 is conveyed, by a plurality of pairs of feed rollers 131 to 134 that are disposed in a conveying path 130, in a conveying direction indicated by an arrow Y to the secondary transfer position in which the secondary transfer unit 51 is opposed to the primary transfer belt 6, and then the color toner image on the primary transfer belt 6 is secondarily transferred onto the paper sheet P in the secondary transfer position.

The paper sheet P, onto which the color toner image that has been secondarily transferred, is conveyed to the fixing device 15. Then, the paper sheet P, after the color toner image having been fixed and fused thereon by the fixing device 15, is output from the image forming apparatus 100 by a pair of paper output rollers 135.

Figure 2:
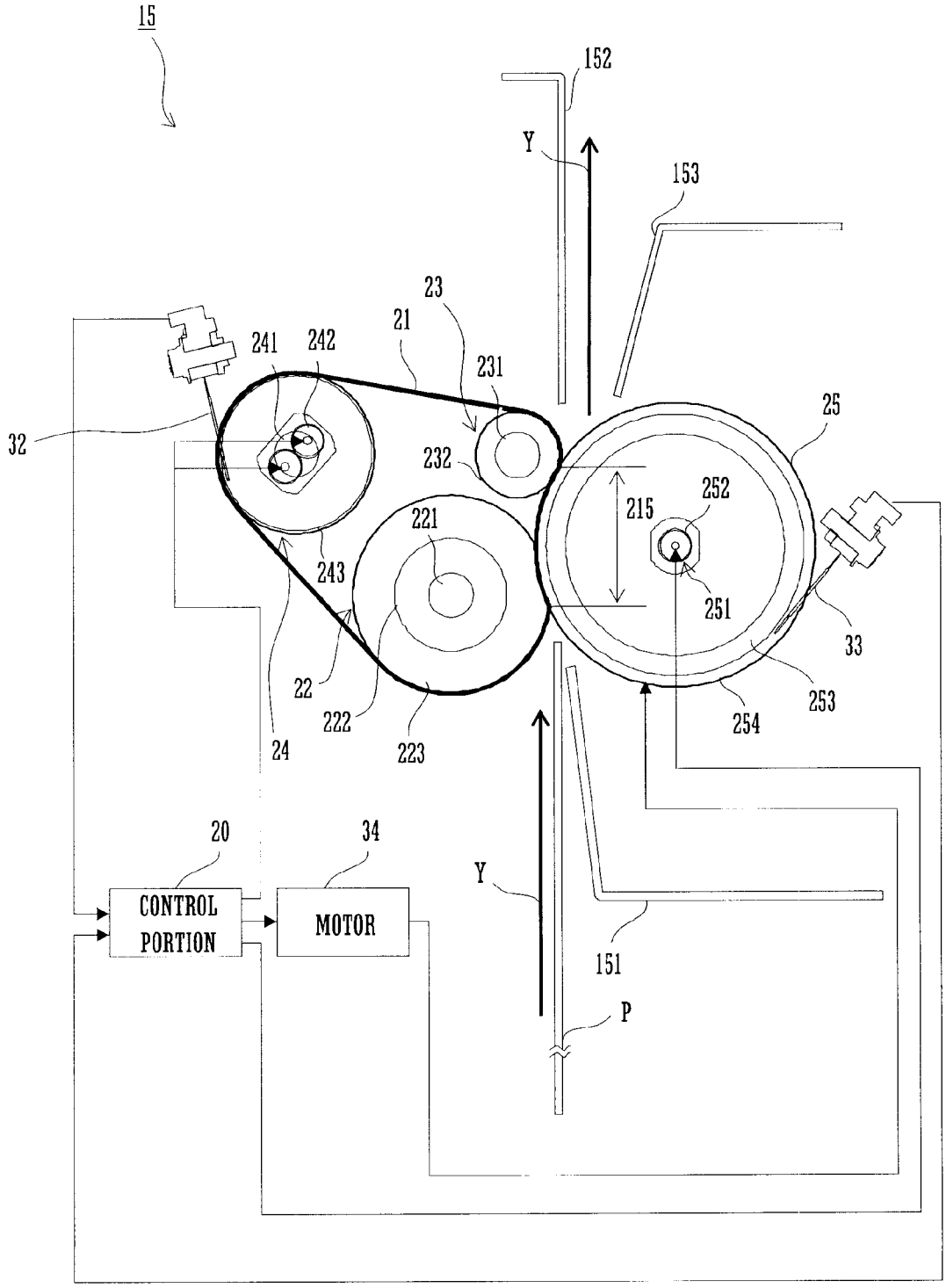
FIG. 2 is a sectional view showing a structure of a fixing device according to the embodiment of the present invention.
Figure 3:
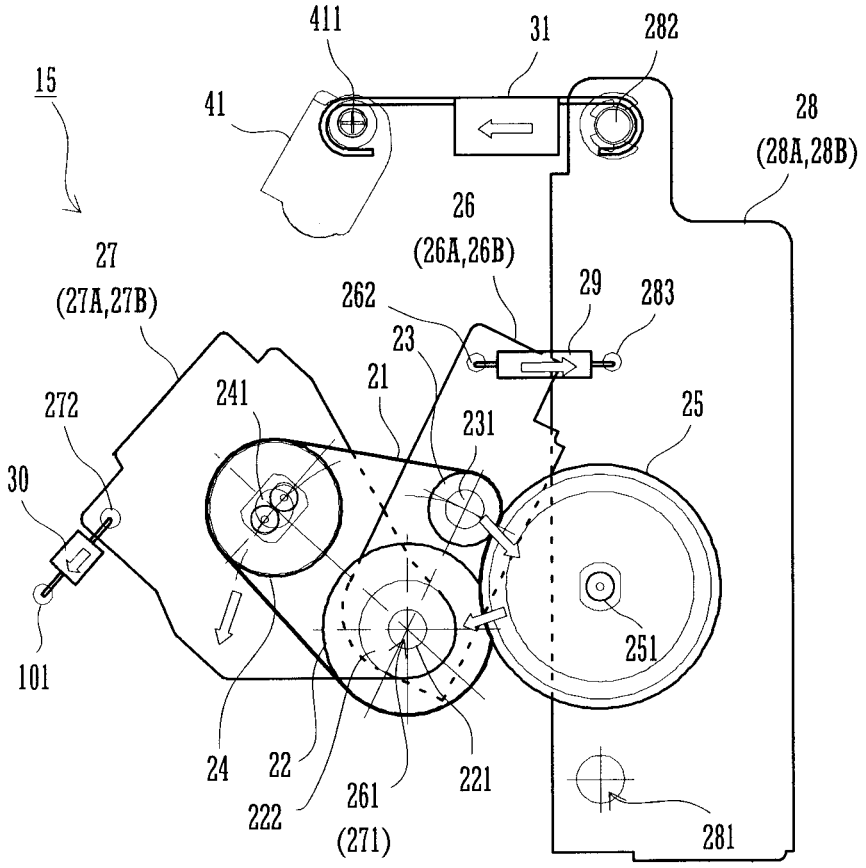
FIG. 3 is a sectional view showing a structure related to formation of a fixing nip portion of the fixing device according to the embodiment of the present invention.

Subsequently, a specific structure of the fixing device 15 according to an embodiment of the present invention is described. FIG. 2 shows the overall structure of the fixing device 15, and FIG. 3 shows a structure related to formation of the fixing nip portion of the fixing device 15.

The fixing device 15 includes: a fixing belt 21; a fixing roller 22; a separating roller 23; a heating roller 24; a pressurizing roller 25; a first lever 26; a second lever 27; a third lever 28; a first spring 29 as a first biasing member; a second spring 30 as a second biasing member; and a third spring 31 as a third biasing member. The fixing device 15 also includes a first temperature sensor 32 and a second temperature sensor 33. Further, the fixing device 15 includes sheet guides 151 to 153. Additionally, the fixing device 15 includes a control portion 20.

The fixing belt 21 is an endless belt and is suspended by the fixing roller 22, the separating roller 23, and the heating roller 24. The fixing belt 21 is configured to form a triangular shape having rounded corners, as shown in FIG. 2 and FIG. 3.

In the fixing device 15, the pressurizing roller 25 is a drive roller that is rotated at a constant speed by a motor 34; and the fixing roller 22, the separating roller 23, and the heating roller 24 are idle rollers that are rotated at a constant speed by the fixing belt 21 in conjunction with the rotation of the pressurizing roller 25. The control portion 20 controls the motor 34 for rotating the pressurizing roller 25.

Figure 4:
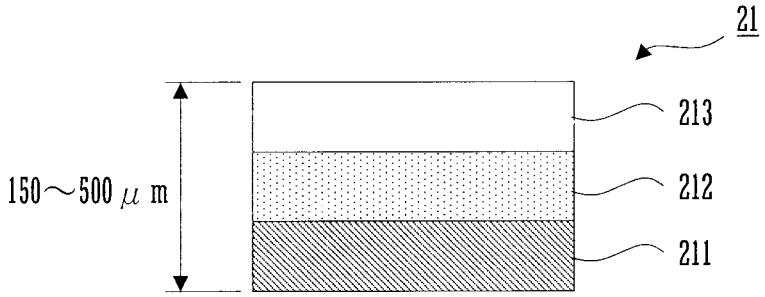
FIG. 4 is a sectional view of a fixing belt.
Figure 5:
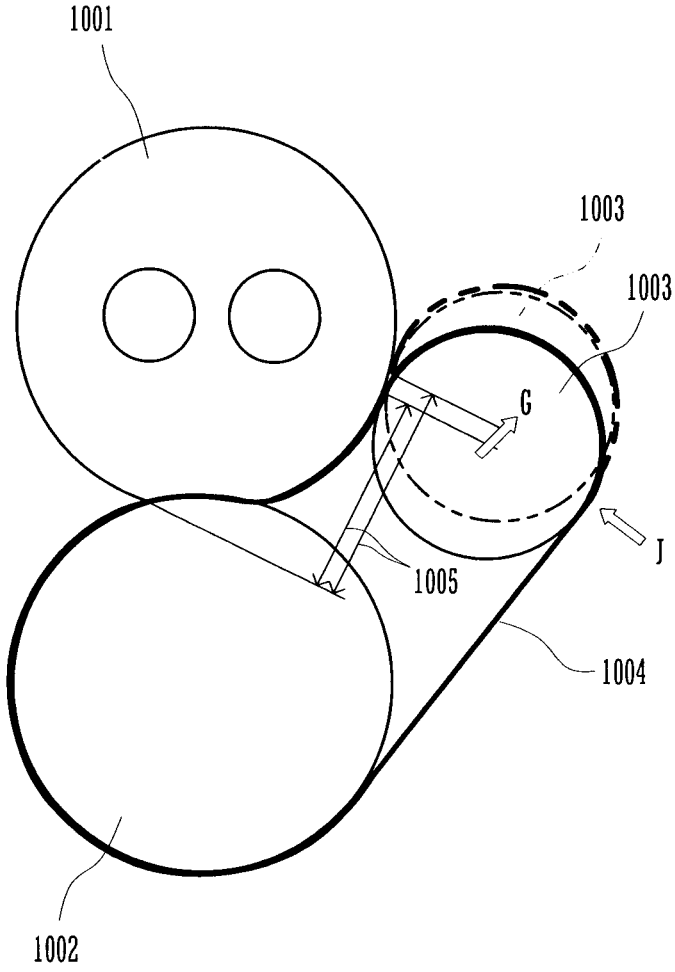
FIG.5 PRIOR ART
FIG. 5 is a sectional view showing a structure of a conventional fixing device.

As shown in FIG. 4, the fixing belt 21 has a three-layered structure, and includes: a base material 211, an elastic layer 212, and a separating layer 213 that are laminated in order from the inner peripheral side to the outer peripheral side. The base material 211 is composed of a thin film of polyimide, stainless steel (SUS), or nickel (Ni). The elastic layer 212 is formed of silicone rubber. The separating layer 213 is formed of polytetrafluoroethylene (PFA), which is tetrafluoroethylene resin; and has characteristics such as non-stickiness and self-lubricating properties. As the fixing belt 21, a thin belt is used to reduce thermal capacity. The thickness of the fixing belt 21 ranges from 150 μm to 500 μm, for example. Each thickness of the base material 211, the elastic layer 212, and the separating layer 213 may be set according to the conditions such as a conveying speed of the paper sheet P and a heating temperature.

With reference to FIG. 2 and FIG. 3 again, the fixing roller 22 includes a rotating shaft 221, a core metal portion 222, and an elastic layer 223. The rotating shaft 221 extends from the both ends of the fixing roller 22. The core metal portion 222 is a hollow cylinder formed of metal such as iron (Fe) and aluminum (Al). The elastic layer 223 is formed of material such as urethane sponge and silicone rubber and is provided around the core metal portion 222. The fixing roller 22 holds the paper sheet (the recording material) P therebetween with the pressurizing roller 25 through the fixing belt 21.

The separating roller 23 includes a rotating shaft 231 and a core metal portion 232. The rotating shaft 231 extends from the both ends of the separating roller 23. The separating roller 23 separates, from the fixing belt 21, the paper sheet P on which toner (a developer) is fixed and fused.

The heating roller 24 includes a rotating shaft 241, a heat source 242, and a core metal portion 243. The rotating shaft 241 extends from the both ends of the heating roller 24. The heating roller 24 heats the core metal portion 243 by the heat source 242. The heat source 242 is made of a heating wire or a halogen lamp (a heater lamp) and is installed in the central part of the heating roller 24 in order to uniformly heat the core metal portion 243. The core metal portion 243 is a hollow cylinder formed of metal such as iron (Fe) and aluminum (Al), and has a radial thickness of 0.4 mm to 1.2 mm and a small heat capacity. The heating roller 24 suspends the fixing belt 21 by the core metal portion 243 and heats the fixing belt 21. The first temperature sensor 32 measures a surface temperature of the heating roller 24. The control portion 20 controls operation of the heat source 242 by turning the heat source 242 ON and OFF and by adjusting the amount of heat according to the surface temperature of the heating roller 24, measured by the first temperature sensor 32.

The pressurizing roller 25 includes a rotating shaft 251, a heat source 252, a core metal portion 253, and an elastic layer 254. The rotating shaft 251 extends from the both ends of the pressurizing roller 25. The pressurizing roller 25 heats the core metal portion 253 by the heat source 252. The heat source 252 is made of a heating wire or a halogen lamp (a heater lamp), and is installed in the central part of the heating roller 24 in order to uniformly heat the core metal portion 253 and the elastic layer 254. The core metal portion 253 is a hollow cylinder formed of metal such as iron (Fe) and aluminum (Al). The elastic layer 254 is formed of material such as urethane sponge and silicone rubber and is provided around the core metal portion 253.

The pressurizing roller 25 presses against the fixing roller 22 and the separating roller 23 through the fixing belt 21 to form a fixing nip portion 215 between the fixing belt 21 and the roller itself. The fixing nip portion 215 has a length from a portion where the fixing roller 22 is in contact with the pressurizing roller 25 through the fixing belt 21 to a portion where the separating roller 23 is in contact with the pressurizing roller 25 through the fixing belt 21. The pressurizing roller 25 fixes and fuses toner on the paper sheet P in the fixing nip portion 215. The second temperature sensor 33 measures a surface temperature of the pressurizing roller 25. The control portion 20 controls amount of heat of the heat source 252 by turning the heat source 252 ON and OFF and by adjusting the amount of heat according to the surface temperature of the pressurizing roller 25, measured by the second temperature sensor 33. In the fixing nip portion 215, heat and pressure are applied to the paper sheet P in which toner has been transferred to fix and fuse the toner onto the paper sheet P.

In the present invention, the surface (the elastic layer 254) of the pressurizing roller 25 is heated by the heat source 252. Thereby, the fixing performance of the fixing device 15 can be improved.

The first lever 26 (26A, 26B) is installed in the both side parts of the fixing roller 22 and the separating roller 23. The rotating shaft 221 of the fixing roller 22 and the rotating shaft 231 of the separating roller 23 are freely and rotatably fixed to the first lever 26 in a predetermined interval. The first lever 26 can freely pivot by using the rotating shaft 221 of the fixing roller 22 as a supporting point 261.

One end of the first spring 29 is fixed to an end on the opposite side of the supporting point 261 of the first lever 26, that is, a point 262 on the opposite side of the first supporting point 261 with the separating roller 23 held therebetween. The other end of the first spring 29 is fixed to a point 283 of the third lever 28. The first spring 29 always biases the first lever 26 with a predetermined force, the first lever 26 pivots in the direction in which the lever approaches the pressurizing roller 25 by using the supporting point 261 as the center point, and the separating roller 23 is brought into pressure contact with the pressurizing roller 25 through the fixing belt 21.

The second lever 27 (27A, 27B) is installed in the both side parts of the fixing roller 22 and the heating roller 24. The rotating shaft 221 of the fixing roller 22 and the rotating shaft 241 of the heating roller 24 are freely and rotatably fixed to the second lever 27 in a predetermined interval. The second lever 27 can freely pivot by using the rotating shaft 221 of the fixing roller 22 as a supporting point 271.

One end of the second spring 30 is fixed to an end on the opposite side of the supporting point 271 of the second lever 27, that is, a point 272 on the opposite side of the second supporting point 271 with the heating roller 24 held therebetween. The other end of the second spring 30 is fixed to a point 101 of the main body of the image forming apparatus 100. The second spring 30 always biases the second lever 27 with a predetermined force, the second lever 27 pivots in the direction in which the lever separates from the separating roller 23 by using the supporting point 271 as the center point, and the heating roller 24 stretches the fixing belt 21.

The third lever 28 (28A, 28B) is installed in the both side parts of the pressurizing roller 25. A rotating shaft 251 of the pressurizing roller 25 is freely and rotatably fixed to the third lever 28. The third lever 28 can freely pivot around a point (a lower point of the rotating shaft 251 in FIG. 3) that is separated, by a predetermined distance, from the pressurizing roller 25 by using the point as a third supporting point 281.

One end of the third spring 31 is fixed to an end on the opposite side of the supporting point 281 of the third lever 28, that is, a point 282 on the opposite side of the third supporting point 281 with the pressurizing roller 25 held therebetween.

The other end of the third spring 31 is fixed to a point 411 of a fixing portion 41 installed near a sheet guide 152 (as shown in FIG. 2). The third spring 31 always biases the third lever 28 with a predetermined force, the third lever 28 pivots in the direction in which the lever approaches the fixing roller 22 by using the supporting point 281 as the center point, and the pressurizing roller 25 is brought into pressure contact with the fixing roller 22 through the fixing belt 21.

The sheet guides 151 to 153 restrict the conveying direction of the paper sheet P.

In the present invention, characteristic operational effects can be achieved by the characteristic structure of the fixing device 15. The following summarizes the content.

(1) The nip length of the fixing nip portion 215 is always constant without changing, so that the fixing process can be stably performed.

Since the rotating shaft 221 of the fixing roller 22 and the rotating shaft 231 of the separating roller 23 are fixed to the first lever 26, the interval between the fixing roller 22 and the separating roller 23 does not change. Therefore, the nip length of the fixing nip portion 215 formed by the fixing belt 21, the fixing roller 22, the separating roller 23, and the pressurizing roller 25 is always constant without changing, so that the fixing process can be stably performed. In addition, no adjustment of the nip length is required, and assembling work efficiency is improved.

(2) The fixing belt 21 can be prevented from being deflected in the fixing nip portion 215.

The fixing belt 21, by using the fixing roller 22 as a supporting point, is stretched with a constant tension by the separating roller 23 fixed to the first lever 26, and the heating roller 24 fixed to the second lever 27. Thereby, the fixing belt 21 can be prevented from being deflected in the fixing nip portion 215. In addition, even if the fixing belt 21 extends, the nip length of the fixing nip portion 215 and the tension force of the fixing belt 21 are constant, and no positional adjustment of each roller is required.

(3) An inexpensive spring having a small biasing force can be used, so that the cost can be reduced.

The rotating shaft 231 of the separating roller 23 is fixed to the first lever 26. In the first lever 26, an end on the opposite side of the fixing roller 22 (a supporting point) with the separating roller 23 held therebetween is biased by the first spring 29. Thus, by the principle of the lever, the separating roller 23 can be pressed against the pressurizing roller 25 by a smaller force than a force used when the separating roller is directly pressed against the pressurizing roller, which enables an inexpensive spring having a small biasing force to be used, so that the cost can be reduced.

Similarly, the rotating shaft 241 of the heating roller 24 is fixed to the second lever 27. In the second lever 27, an end on the opposite side of the fixing roller 22 (a supporting point) with the heating roller 24 held therebetween is biased by the second spring 30. Thus, by the principle of the lever, the heating roller 24 can be biased by a force smaller than a force used when the rotating shaft of the heating roller 24 is directly biased, which enables an inexpensive spring having a small biasing force to be used, so that the cost can be reduced.

Similarly, the rotating shaft 251 of the pressurizing roller 25 is fixed to the third lever 28. The third lever 28 has a supporting point 281 and a point of application 282 which hold the heating roller 24 therebetween, and the point of application is biased by the third spring 31 around the supporting point 281 used as the center point. Thus, by the principle of the lever, a force that causes the pressurizing roller 25 to press against the fixing roller 22 can be made smaller than a force used when the pressurizing roller is pressed directly, which enables an inexpensive spring having a small biasing force to be used.

(4) The fixing roller 22 has elasticity, so that the nip length of the fixing nip portion 215 can be secured and the fixing performance can be improved.

In a structure in which a fixing belt is suspended by two rollers, a heating roller needs to face a pressurizing roller. In the present invention, the fixing belt 21 is suspended by the three rollers: the fixing roller, the pressurizing roller, and the heating roller. Thus, the fixing roller 22 having no heating function and including an elastic layer 223 can be faced to the pressurizing roller 25 and the heating roller 24 can be installed upstream from the fixing roller 22 in the conveying direction of the fixing belt 21. Thereby, the fixing roller 22 has elasticity, so that the fixing nip portion can be secured and the fixing performance can be improved. Since no elastic layer needs to be installed in the heating roller 24, the radial thickness can be made thin and then the heat capacity can be small. In addition, the adoption of a belt having a small heat capacity as the fixing belt 21 and the rotation of the fixing belt 21 at a high speed can improve the heat transfer characteristics to the fixing nip portion 215. Thereby, the heating roller 24 and the fixing belt 21 can be heated with a little energy and a short time. Accordingly, the fixing process can be started in a short time, which improves the operability of the fixing device 15 and the image forming apparatus 100.

(5) The amount of heat given to toner in the fixing nip portion 215 can be stabilized.

Since the rotating shaft 221 of the fixing roller 22 and the rotating shaft 241 of the heating roller 24 are fixed to the second lever 27, the interval of the fixing roller 22 and the heating roller 24 does not change. The fixing belt 21 rotates at a constant speed, so that the time until a portion of the fixing belt 21 heated by the heating roller 24 reaches the fixing nip portion 215 becomes constant, and the amount of heat given to toner in the fixing nip portion 215 can be stabilized. Therefore, the fixing process can be stably performed. In addition, no adjustment of the interval between the fixing roller 22 and the heating roller 24 is required, and assembling work efficiency is improved.

(6) The heat source 252 is provided in the pressurizing roller 25, so that toner can be surely fixed and fused by heating the fixing belt 21 in an auxiliary manner by the heat source 252 of the pressurizing roller 25.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device comprising:

a fixing belt in an endless form;

a fixing roller for suspending the fixing belt;

a separating roller for suspending the fixing belt and separating a recording material from the fixing belt;

a pressurizing roller for pressing against the fixing roller and the separating roller through the fixing belt to form a fixing nip portion between the fixing belt and the pressurizing roller;

a heating roller including:

a core metal portion; and a heat source for heating the core metal portion, the heating roller suspending the fixing belt by the core metal portion, and heating the fixing belt;

a first lever to which a rotating shaft of the fixing roller and a rotating shaft of the separating roller are fixed, the first lever pivoting around the rotating shaft of the fixing roller used as a first supporting point;

a second lever to which the rotating shaft of the fixing roller and a rotating shaft of the heating roller are fixed, the second lever pivoting around the rotating shaft of the fixing roller used as a second supporting point;

a first biasing member for biasing the first lever and causing the separating roller to press against the pressurizing roller; and a second biasing member for biasing the second lever and causing the fixing belt to stretch over the heating roller.

2. The fixing device according to claim 1, further comprising:

a third lever to which a rotating shaft of the pressurizing roller is fixed, the third lever pivoting around a point that is separated, by a predetermined distance, from the pressurizing roller by using the point as a third supporting point; and a third biasing member attached, in the third lever, as opposed to the third supporting point with the pressurizing roller held therebetween, the third biasing member biasing the third lever and causing the pressurizing roller to press against the fixing roller.

3. The fixing device according to claim 2, wherein the pressurizing roller includes a heat source therein.

4. An image forming apparatus comprising:

the fixing device according to claim 1; and an image forming portion for forming an image by transferring a developer to a recording material conveyed to the fixing device.

5. An image forming apparatus comprising:

the fixing device according to claim 2; and an image forming portion for forming an image by transferring a developer to a recording material conveyed to the fixing device.

6. An image forming apparatus comprising:

the fixing device according to claim 3; and an image forming portion for forming an image by transferring a developer to a recording material conveyed to the fixing device.

* * * * *